US010500703B2

(12) United States Patent
Blessing

(10) Patent No.: US 10,500,703 B2
(45) Date of Patent: Dec. 10, 2019

(54) PYROTECHNIC DRIVING DEVICE

(71) Applicant: Hilti Aktiengesellschaft, Schaan (LI)

(72) Inventor: Matthias Blessing, Frastanz (AT)

(73) Assignee: HILTI AKTIENGESELLSCHAFT, Schaan (LI)

( * ) Notice: Subject to any disclaimer, the term of this patent is extended or adjusted under 35 U.S.C. 154(b) by 362 days.

(21) Appl. No.: 15/122,966

(22) PCT Filed: Mar. 24, 2015

(86) PCT No.: PCT/EP2015/056226
§ 371 (c)(1),
(2) Date: Sep. 1, 2016

(87) PCT Pub. No.: WO2015/144687
PCT Pub. Date: Oct. 1, 2015

(65) Prior Publication Data

US 2017/0100830 A1 Apr. 13, 2017

(30) Foreign Application Priority Data

Mar. 28, 2014 (EP) ..... 14162168

(51) Int. Cl.
*B25C 1/14* (2006.01)

(52) U.S. Cl.
CPC ..... *B25C 1/143* (2013.01)

(58) Field of Classification Search
CPC .. B25C 1/143; B25C 1/14; B25C 1/18; B25C 1/08; B25C 1/082; B25C 1/04;
(Continued)

(56) References Cited

U.S. PATENT DOCUMENTS 3,204,400 A * 9/1965 Kvavle ..... B25C 1/14 227/10
3,549,074 A * 12/1970 Brunelle ..... B25C 1/143 227/10

(Continued)

FOREIGN PATENT DOCUMENTS

| | | |
|---|---|---|
| DE | 14 78 826 A1 | 1/1969 |
| EP | 0 788 863 A1 | 8/1997 |
| GB | 2 074 704 A | 11/1981 |

OTHER PUBLICATIONS

International Bureau, International Search Report in International Patent Application No. PCT/EP2015/056226, dated Jun. 10, 2015.

(Continued)

*Primary Examiner* — Alexander M Valvis
*Assistant Examiner* — David G Shutty
(74) *Attorney, Agent, or Firm* — Leydig Voit & Mayer, Ltd.

(57) ABSTRACT

A driving device is provided comprising a hand-held housing with a piston member arranged therein for transmitting energy to a securing element to be driven in; an interchangeable propellant charge and a combustion chamber arranged between the propellant charge and the piston member, the combustion chamber extending around a central axis (A); and an actuator, by which the energy transmitted by the propellant charge to the piston member can be variably adjusted. The driving device also includes a blow-off channel connected to the combustion chamber that can be exposed by a movable slide of the actuator and the movable slide comprises a body which completely encircles the central axis (A).

21 Claims, 5 Drawing Sheets

(58) Field of Classification Search
CPC ..... B25C 1/10; B25D 17/06; B25D 17/24; B25D 17/26; B25D 2217/0019; B25D 2250/345
See application file for complete search history.

(56) References Cited

U.S. PATENT DOCUMENTS 3,899,113 A * 8/1975 Brack ..... B25C 1/082 227/10
4,068,790 A * 1/1978 Osterle ..... B25C 1/18 227/8
4,119,257 A * 10/1978 Combette ..... B25C 1/082 227/10
4,153,192 A * 5/1979 Jochum ..... B25C 1/14 227/10
4,358,041 A * 11/1982 Ollivier ..... B25C 1/188 227/10
4,382,533 A * 5/1983 Buechel ..... B25C 1/082 227/10
4,577,793 A * 3/1986 Jochum ..... B25C 1/14 227/10
4,595,134 A * 6/1986 Jochum ..... B25C 1/18 227/10
4,883,212 A * 11/1989 Philipp ..... B25C 1/18 227/9
5,029,744 A * 7/1991 Pai ..... B25C 1/143 227/10
5,699,948 A * 12/1997 Lee ..... B25C 1/14 227/10
5,732,869 A * 3/1998 Hirtl ..... B25C 1/143 227/10
5,767,434 A * 6/1998 Hirtl ..... B25C 1/14 89/1.14
5,975,397 A * 11/1999 Van Erden ..... B25C 1/04 227/10
5,996,875 A * 12/1999 Clark ..... B25C 1/18 227/10
6,032,846 A * 3/2000 Clark ..... B25C 1/14 227/10
6,123,242 A * 9/2000 Kersten ..... B25C 1/14 173/212
6,321,968 B1 * 11/2001 Remerowski ..... B25C 1/18 227/10
6,364,190 B1 * 4/2002 Tor ..... B25C 1/14 227/10
8,002,160 B2 * 8/2011 Larkin ..... B25C 1/08 123/46 A
9,272,408 B2 * 3/2016 Koch ..... B25D 17/24
2007/0000458 A1 * 1/2007 Neumann ..... B25C 1/082 123/46 H
2008/0251561 A1 * 10/2008 Eades ..... B25C 1/14 227/10
2010/0258609 A1 * 10/2010 Lee ..... B25C 1/143 227/10
2013/0032227 A1 * 2/2013 Murai ..... F15B 11/046 137/544
2016/0303725 A1 * 10/2016 Goepfert ..... B25C 1/14
2016/0311096 A1 * 10/2016 Blessing ..... B25C 1/143
2016/0311097 A1 * 10/2016 Blessing ..... B25C 1/143
2016/0311098 A1 * 10/2016 Blessing ..... B25C 1/143
2016/0311099 A1 * 10/2016 Voulkidis ..... B25C 1/143
2017/0072549 A1 * 3/2017 Blessing ..... B25C 1/18
2017/0100830 A1 * 4/2017 Blessing ..... B25C 1/143

OTHER PUBLICATIONS

European Patent Office, European Search Report in European Patent Application No. 14162168.0, dated Sep. 11, 2014.

* cited by examiner

PYROTECHNIC DRIVING DEVICE

CROSS-REFERENCE TO RELATED APPLICATIONS

This patent application is the U.S. National Stage of International Patent Application No. PCT/EP2015/056226, filed Mar. 24, 2015, which claims the benefit of European Patent Application No. 14162168.0, filed Mar. 28, 2014, which are each incorporated by reference.

BACKGROUND OF THE INVENTION

The invention relates to a driving-in device according to the preamble of claim 1.

From the prior art, hand-held driving-in devices with propelling charges are known, wherein after the ignition of a pyrotechnical charge, the resulting combustion gases expand in a combustion chamber. As a result, a piston as the energy transfer means is accelerated and drives a fastening element into a workpiece.

U.S. Pat. No. 6,321,968 B1 describes a driving-in device with a propelling charge, wherein the combustion chamber is divided into an upper subchamber and a lower subchamber by a perforated disc. The driving-in device is provided with adjustability of a dead space volume in order to modify the drive-in energy of the device in an adjustable manner. To this end, a valve-like slide can be adjusted in a direction perpendicular to a driving-in axis. Here, the combustion chamber has a dead space also in a closed condition of the slide, which is formed as a recess in a lateral wall of the combustion chamber.

BRIEF SUMMARY OF THE INVENTION

It is the object of the invention to provide a driving-in device that allows a simple adjustment of a driving-in energy, if necessary over a range as broad as possible given a certain propelling charge.

According to the invention, this object is achieved for a driving-in device as mentioned in the beginning by the characterising features of claim 1. As a result of the implementation of the slide as a body that completely encircles the central axis, the release of the blow-off channel can be realised to be mechanically stable and over a wide control range.

A body that completely encircles the central axis may be understood to be for example a substantially cylindrical sleeve. Generally preferably, the piston element may be guided over at least a first part of its movement in the slide. A modifiable release of the blow-off channel or of a plurality of blow-off channels can be carried out, depending on the detailed design, by way of an adjustment of the slide in an axial direction and/or in the circumferential direction.

A blow-off channel in terms of the invention is any space that can be added to the combustion chamber volume in a selectable manner by the adjustment element, in order to modify a drive-in energy via the additional expansion space in a defined manner. Preferably, but not necessarily, the blow-off channel may here be connected to an external space. Alternatively or in addition thereto, the blow-off channel may be a dead space volume that is not connected to an external space.

A drive-in energy in terms of the invention is understood to be the motion energy of any given fastening element at a given propelling charge. Once these boundary conditions have been set, it is possible to use the actuator to modify the resulting drive-in energy of the fastening element in an adjustable manner.

A piston element in terms of the invention is any means to which motion energy can be applied by the ignition of the charge, which motion energy is ultimately transferred on to the fastening element. Frequently, the piston element is implemented in particular as a cylindrical piston. In the piston bottom, recesses or other structures may be provided which further favour turbulences and a uniform expansion of the combustion gases.

A central axis in terms of the invention is an axis that is at least parallel to the movement of the fastening element, which extends through a centre of the combustion chamber. Preferably, the central axis extends both through the centre of the combustion chamber and through a centre of the fastening element.

A fastening element in terms of the invention is generally understood to be any anchoring that can be driven in, such as for example a nail, a bolt or a screw.

In a preferred embodiment of the invention, the slide can be rotated about the central axis, in order to adjust a cross section of the blow-off channel. Particularly preferably, the slide is here supported in a forced guide, and a rotation of the slide about the central axis effects a movement of the slide in the direction of the central axis. In this way, the axial adjustment can be carried out particularly accurately. In a particularly preferred detailed embodiment, the forced guide comprises a preferably multi-start thread, a link or a sliding block. As a result, for example a great thread pitch can be combined with a mechanically secure guide.

Generally advantageously, the slide has a preferably cylindrical inner wall that is formed as part of the combustion chamber. In such an arrangement, the slide expediently also serves for guiding the piston element in a first section of the piston movement.

In order to achieve a simple and intuitive adjustment of the drive-in energy, the actuator has an operating unit that can be pivoted about the central axis. The operating unit may be any suitable means for manual adjustment, such as for example a rotatable sleeve as a particularly preferred variant, a pivotable head or similar.

Due to the pivotability of the operating unit about the central axis, a simple adjustment with at the same time an effective visual check of the adjusted value can be achieved. Moreover, such an arrangement allows a simple adjustment even under unfavourable conditions such as for example when work gloves are being worn.

Generally advantageously, the operating unit is formed as an annular sleeve, which sleeve encircles the central axis. In order to adjust the drive-in energy, the sleeve may be rotated into a plurality of different positions, and at least two different positions have associated therewith two different drive-in energies. For an advantageous operation, the sleeve may be held in at least one defined position by means of a latching element. Such defined positions may be a maintenance position or a defined position for modifying the drive-in energy.

An operating unit according to the invention and in particular a sleeve as described above may be provided in a front region ahead of a handle of the device, in order to optimise the ergonomics of the device. Here, by a suitable arrangement and design of the operating unit, an advantageous analogy to known operating units of hand-held drilling machines and/or cordless screwdrivers may be achieved. The operating units of such devices are here correspondingly used for other purposes, for example for a torque adjustment or a switchover from screw operation to hammer operation in an impact drill.

Pivoting the operating unit about the central axis means here an excursion of the operating unit, which is substantially oriented perpendicular to the axis, from a previous position. A line of movement or trajectory of the operating unit has here a radius of curvature that is preferably no smaller than a distance between the operating unit and the central axis. Preferably, but not necessarily, the pivoting is a rotation about the central axis.

The operating unit and the slide are here preferably connected to each other in a rotationally fixed manner, so that a rotation of the operating unit at the same time effects a rotation and adjustment of the slide for regulating the drive-in energy.

In a particularly preferred realisation of a driving-in device according to the invention, a piston guide provided in front of the combustion chamber is received to be rotatable relative to the housing about the central axis. Particularly advantageously here, the piston guide and the slide are coupled to each other in a rotationally fixed manner and are axially movable relative to each other. In this way, the piston guide fulfils an additional function as a mechanical connection element between the slide and an operating unit.

Generally advantageously it is provided that the slide has a collar that encircles the central axis, which engages, in an overlapping manner, in a recess of a combustion chamber housing, and at least part of the blow-off channel is formed as an axially extending recess between the collar and the combustion chamber housing. As a result, due to the overlap, a high tightness may be achieved also in the case of elevated gas pressures. Moreover, a connection between the blow-off channel and the combustion chamber may be released in an adjustable manner even directly on a charge-side end of the combustion chamber, which allows adjustability over a large range of the drive-in energy.

BRIEF DESCRIPTION OF THE SEVERAL VIEWS OF THE DRAWING(S)

Further features and advantages of the invention result from the embodiment example as well as from the dependent claims. A preferred embodiment example of the invention will be described below and will be explained in more detail by means of the attached drawings, wherein:

DETAILED DESCRIPTION OF THE INVENTION

Figure 1:
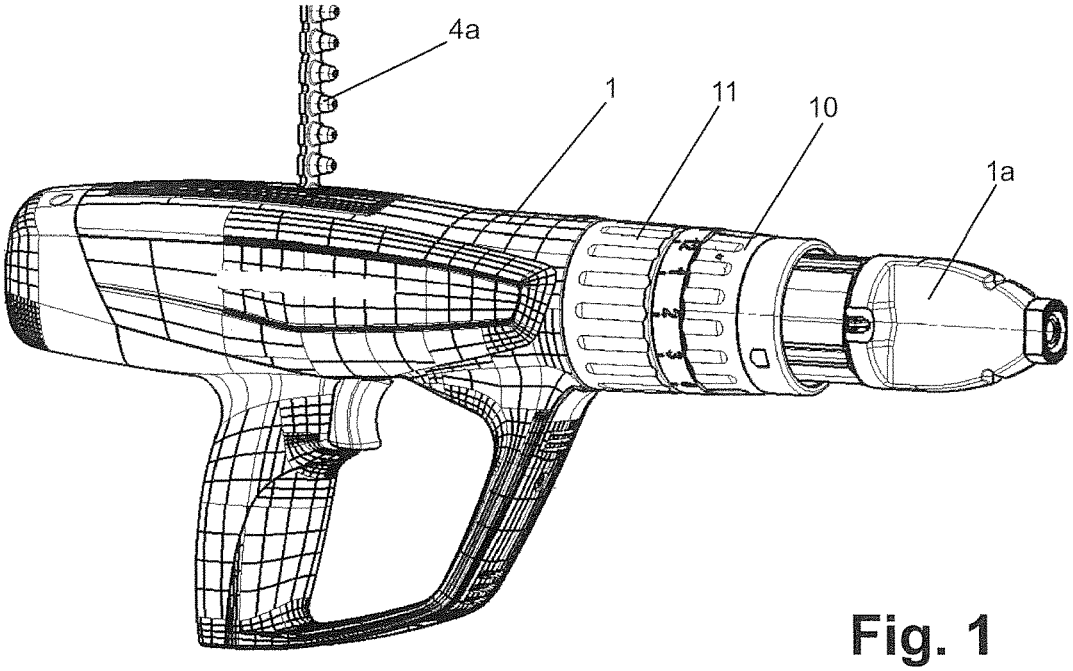
FIG. 1 shows a spatial overall view of a driving-in device according to the invention.
Figure 2:
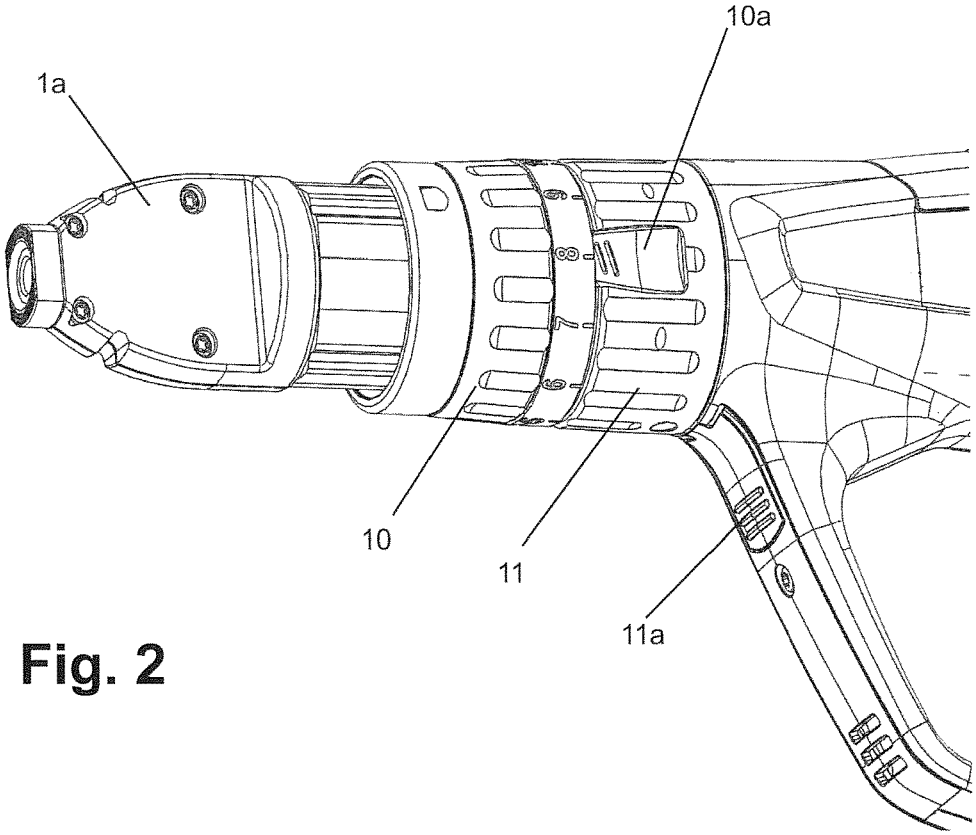
FIG. 2 shows a spatial detailed view of the driving-in device from FIG. 1.
Figure 3:
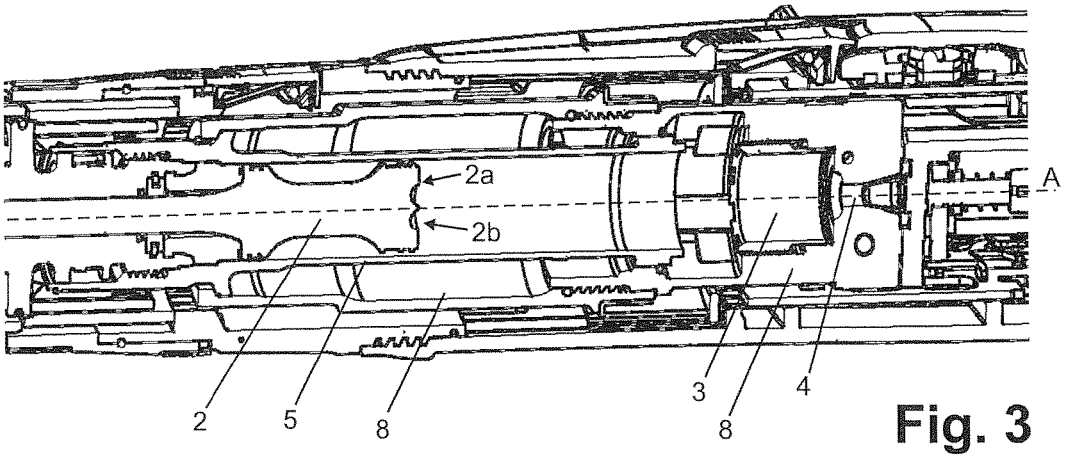
FIG. 3 shows a spatial sectional view of the driving-in device from FIG. 1 along a central axis in the rear region of a piston guide.
Figure 4:
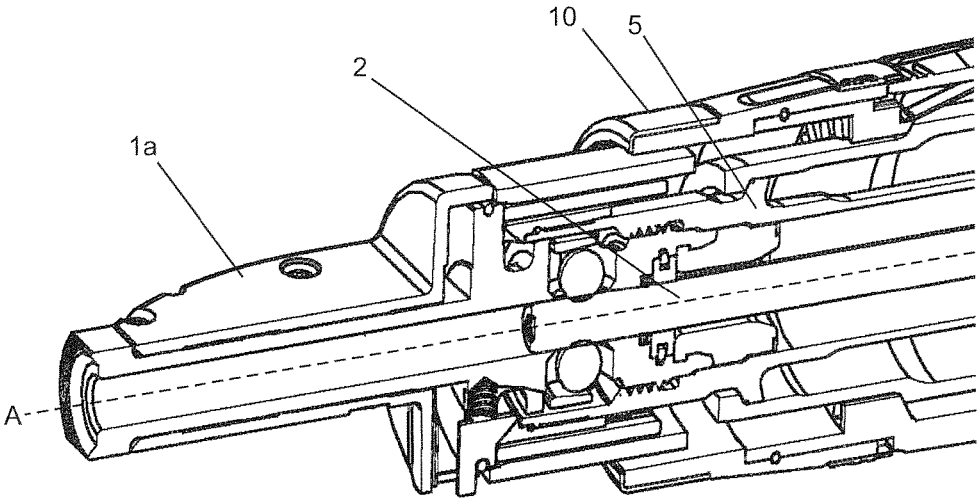
FIG. 4 shows a spatial sectional view of the driving-in device from FIG. 1 along a central axis in a front region of a piston guide.

A driving-in device according to the invention comprises a hand-held housing 1, in which a piston element in the form of a piston 2 is received. A surface 2*a* of the piston 2 delimits a combustion chamber 3, in which the combustion gases of a pyrotechnical charge expand in order to accelerate the piston 2.

The piston 2 to which motion energy is applied impinges with an end-side plunger on to a fastening element (not shown), which as a result is driven into a workpiece. The fastening element may in particular be received in a module or magazine (not shown), which is attached in a replaceable manner in a front holding region 1*a* of the driving-in device 1.

The charge is presently received in a cartridge 4*a* made from metal sheet. The cartridge 4*a* has an impact fuse and is inserted prior to the ignition in a cartridge store 4 by a corresponding loading mechanism, presently by means of a magazine strip. The cartridge and the cartridge store 4 are formed to be rotationally symmetrical about a central axis A. In the present example, the central axis A is at the same time a middle axis of the combustion chamber 3 and of the piston element 2.

The combustion chamber 3 is located between a circular opening of the cartridge store 4 and of the surface 2*a* of the piston 2. Presently, a depression 2*b* is formed in the piston 2, which contributes to an improved turbulence of the combustion gases and forms part of the delimitation of the combustion chamber 3.

The combustion chamber 3 is formed in a first section as a hollow cylindrical, substantially sleeve-shaped body 6. This body 6 is at the same time a slide that can be rotated about the central axis A and can in the course of this be modified in its position in the direction of the central axis A for an adjustable release of one or more blow-off channels 7 for example with a step-shaped cross section.

The blow-off chamber 7 has, spread over the circumference thereof, a plurality of recesses 7*a* in a combustion chamber housing 8. The recesses 7*a* extend axially in the direction parallel to the central axis A and open in a section of the blow-off channel 7 with a larger volume, which section extends between the combustion chamber housing 8 and a piston guide 5.

In the combustion chamber housing 8, a cylindrical recess with a multi-start internal thread 8*a* is located in the region of the combustion chamber. The slide 6 is screwed with a corresponding external thread 6*a* into the opening of the combustion chamber housing 8. A rotation of the slide 6 about the central axis A therefore effects a positively controlled axial offset of the slide 6.

Figure 5:
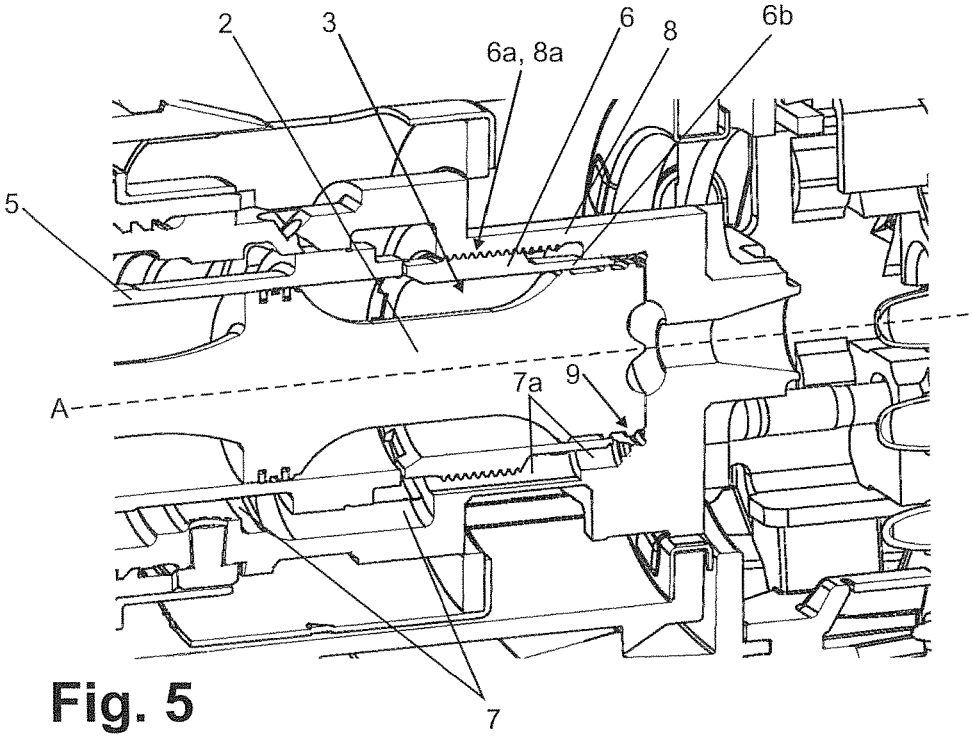
FIG. 5 shows a detailed view of the region of the piston guide from FIG. 3 in an adjustment with reduced drive-in energy.
Figure 6:
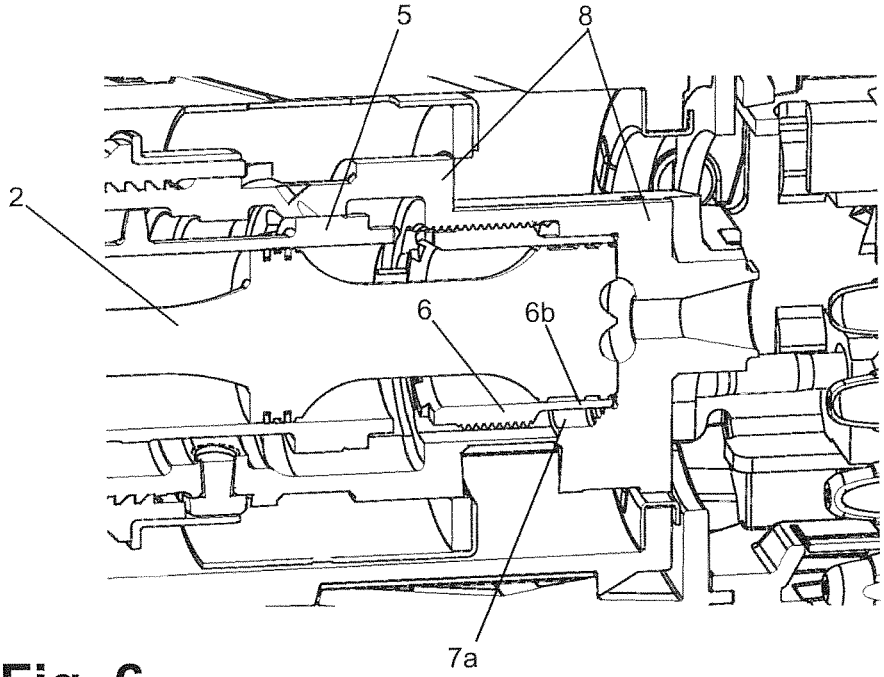
FIG. 6 shows the detailed view from FIG. 5 in an adjustment with maximum drive-in energy.
Figure 7:
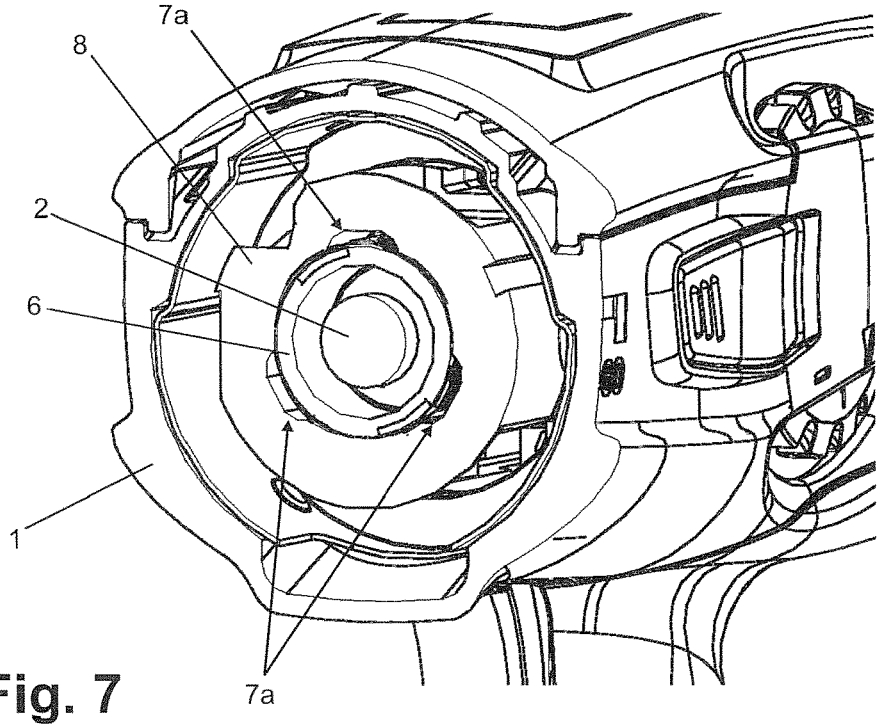
FIG. 7 shows a spatial sectional view of the driving-in device from FIG. 1 transversely to a central axis in a rear region of a piston guide.
Figure 8:
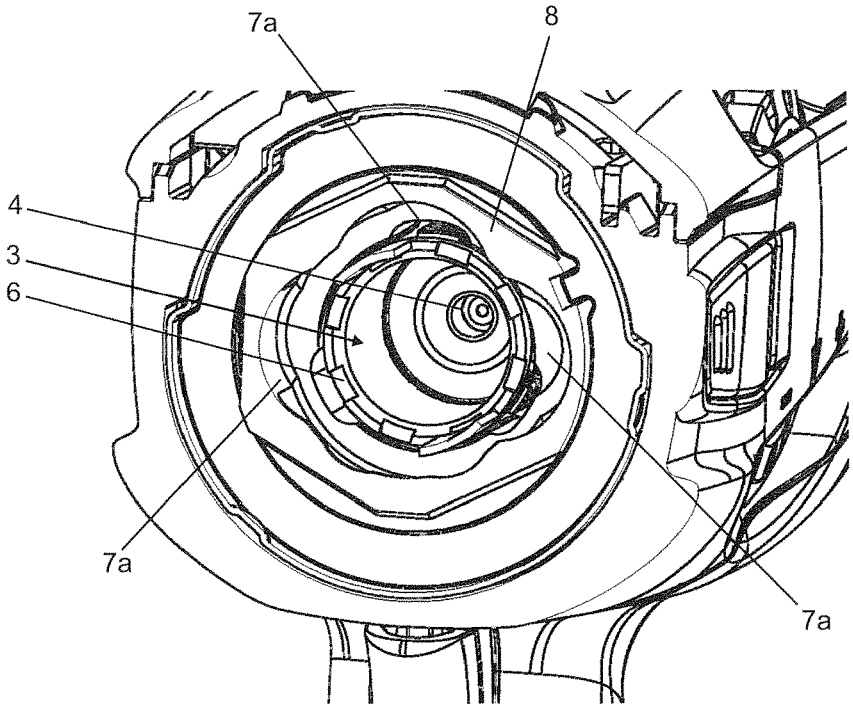
FIG. 8 shows a sectional view as in FIG. 7 with a section plane offset slightly rearwards and with the piston element removed.
Figure 9:
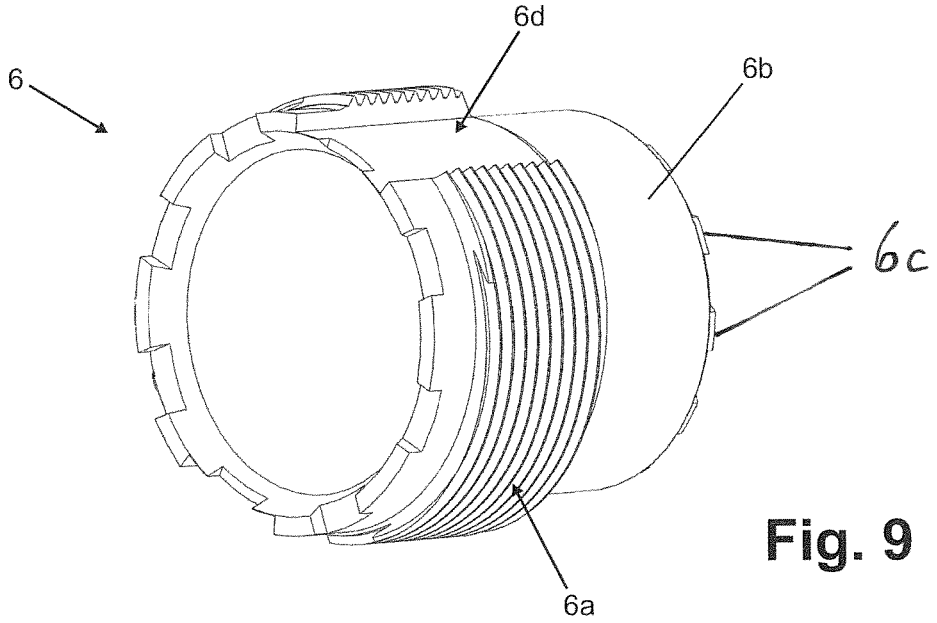
FIG. 9 shows a spatial view of a slide of the driving-in device from FIG. 1.

The slide 6 is provided with a collar 6*b* extending rearwards or in the direction of a bottom of the combustion chamber 3, which collar engages, in an axially overlapping manner, in the recess of the combustion chamber housing 8. Depending on the axial position of the slide 6, a modifiable passage 9 from the combustion chamber 3 into the recesses or blow-off channels 7*a* is released (see FIG. 5). In the case of a slide 6 offset completely rearwards, the passage 9 is closed (see FIG. 6). If an open passage 9 is adjusted, then this is part of the blow-off channel 7*a*, 7. The passage is provided in the axial direction directly in front of the bottom of the combustion chamber 3, so that combustion gases can escape into the blow-off channel as early as immediately prior to the beginning of the piston movement. As a result, a particularly large range of energy reduction can be achieved, depending on the adjustment of the slide 6.

On a front side of the slide 6, axial protrusions 6*c* are formed which, if needed, partially or completely scrape off any deposited dirt.

Figure 10:
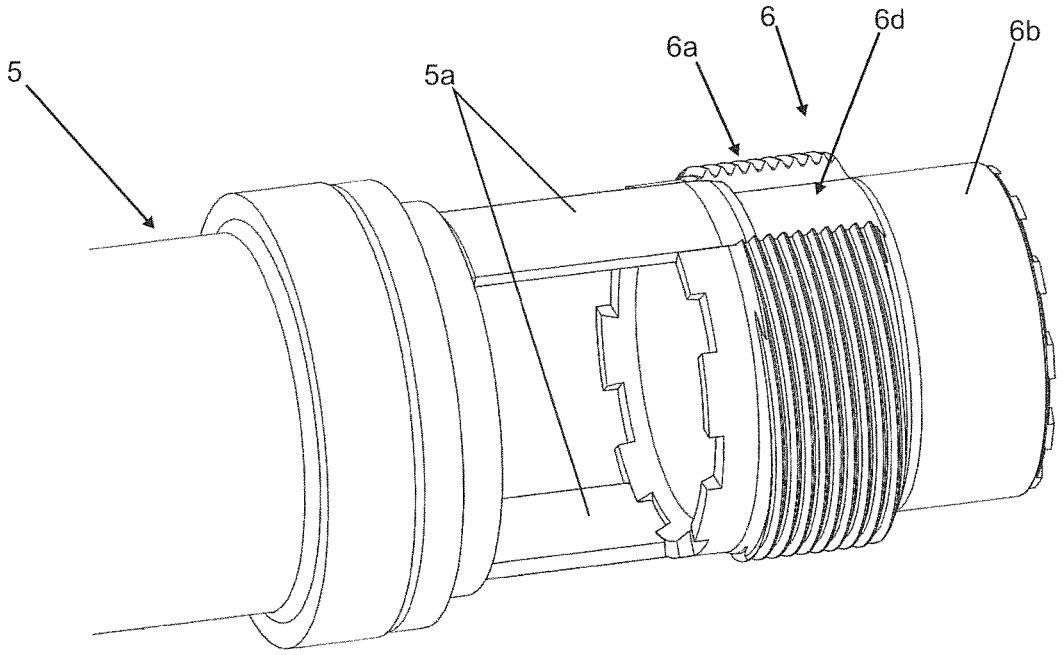
FIG. 10 shows the slide from FIG. 9 in cooperation with a piston guide.

A guiding of the piston 2 is carried out both in the slide 6 and in the piston guide 5 following on from the slide 6 in the driving-in direction. The piston guide 5 is received in the combustion chamber housing so as to be rotatable about the central axis A. The piston guide 5 is coupled with the slide 6 by means of two claws 5*a*, and the axially protruding claws 5*a* engage in two corresponding recesses 6*d* in the slide 6 in a rotationally fixed manner, but so as to be axially displaceable (see FIG. 10). In particular embodiment examples (not shown), the piston guide is coupled with the slide by means of 1, 3, 4, 5 or more claws. Depending on the position of the slide 6, there is therefore a gap over part of the circumference between the slide 6 and the piston guide 5. The length of the slide 6 is correspondingly dimensioned such that the maximum desired driving-in energy is achieved, before the rear end of the piston element 2 covers the gap. The gap also connects the combustion chamber with the blow-off channel 7.

A front end of the piston guide 5 is coupled with an operating unit 10 in a rotationally fixed manner, so that the piston guide 5 at the same time forms a mechanical connection between the operating unit 10 and the slide 6. The operating unit 10 is presently formed as a sleeve that is rotatable in the combustion chamber housing, which sleeve is arranged to be substantially concentric about the central axis A in a front region of the housing 1 of the driving-in device.

The operating unit 10 forms, together with the piston guide 5 and the slide 6, an actuator for modifying the drive-in energy of the driving-in device 1. This adjustment and the driving-in process work as follows:

After a driving-in process, the piston element is in a partially undefined position, which is however displaced as far as possible towards the front. The combustion chamber housing 8 is located in a position pushed to the maximum towards the rear of the driving-in device. The terms "front" and "rear" are presently always selected in relation to the driving-in direction.

Subsequently, in order to prepare the next driving-in process, the desired drive-in energy is adjusted by rotating the sleeve 10 to the energy step marked on the operating unit. This leads, via the forced control described above, to a selected axial position of the slide 6 relative to the combustion chamber housing 8. As a result, the blow-off channel is released or closed in a defined manner via the passage 9 (maximal drive-in energy).

In the present example of the invention, with reduced drive-in energy, a corresponding part of the propelling gases or exhaust gases is discharged towards the outside via the described channels 7*a*, 7. In other embodiments, depending on requirements, also a closed dead space volume may be provided, wherein for example the blow-off channels 7*a* are only used as an optional space extension of the combustion chamber and are not connected with the outside any further. In yet other embodiments it may be provided that the gases passed over the blow-off channels are used for returning the piston by means of gas pressure.

In the present embodiment example, a disassembly of the piston element 2 and the combustion chamber housing 8 is enabled by means of an additional closure ring 11 that is located behind the operating unit 10. The closure ring carries a button 10*a* that is used for securing the operating unit 10 and must be pressed in order to adjust the operating unit. The closure ring 11 is secured in an analogous manner via a button 11 a on the housing of the driving-in device 1.

In an alternative embodiment of the invention, the function mentioned above for disassembling the driving-in device may also be integrated into the operating unit 10.

The invention claimed is:

1. A driving-in device, comprising:

a hand-held housing with a piston element therein for transmitting an amount of energy to a fastening element to be driven in;

a replaceable propelling charge;

a combustion chamber provided between the replaceable propelling charge and the piston element, the combustion chamber extending about a central axis;

a piston guide located in front of the combustion chamber, wherein the piston guide is rotatable relative to the hand-held housing about the central axis axis;

a blow-off channel connected to the combustion chamber;

and, an actuator that is adjustable to modify the amount of energy to be transmitted to the piston element by the replaceable propelling charge, the actuator comprising a movable slide comprising a body which completely encircles the central axis, wherein the moveable slide is supported in a forced guide, and the moveable slide is rotated about the central axis to adjust a cross section of the blow-off channel, and rotation of the moveable slide about the central axis moves the moveable slide in a direction of the central axis and releases gas from the combustion chamber into the blow-off channel, and the piston guide and the moveable slide are axially moveable relative to each other and unrotatable relative to each other.

2. The driving-in device as claimed in claim 1, wherein the forced guide comprises a multi-start thread.

3. The driving-in device as claimed in claim 1, wherein the actuator comprises an operating unit that is pivotable about the central axis.

4. The driving-in device as claimed in claim 3, wherein the moveable slide has a cylindrical inner wall formed as part of the combustion chamber.

5. The driving-in device as claimed in claim 3, wherein the operating unit and the moveable slide are connected in a rotationally fixed manner.

6. The driving-in device as claimed in claim 1, comprising a piston guide located in front of the combustion chamber, wherein the piston guide is rotatable relative to the housing about the central axis.

7. The driving-in device as claimed in claim 5, wherein the moveable slide has a collar that encircles the central axis, which engages in an overlapping manner in a recess of a combustion chamber housing, wherein at least part of the blow-off channel is formed as an axially extending recess between the collar and the combustion chamber housing.

8. The driving-in device as claimed in claim 5, wherein the moveable slide has a cylindrical inner wall formed as part of the combustion chamber.

9. The driving-in device as claimed in claim 1, wherein the moveable slide has a cylindrical inner wall formed as part of the combustion chamber.

10. The driving-in device as claimed in claim 2, wherein the moveable slide has a cylindrical inner wall formed as part of the combustion chamber.

11. The driving-in device as claimed in claim 2, wherein the actuator comprises an operating unit that is pivotable about the central axis.

12. The driving-in device as claimed in claim 6, wherein the actuator comprises an operating unit that is pivotable about the central axis.

13. The driving-in device as claimed in claim 2, comprising the piston guide located in front of the combustion chamber, wherein the piston guide is rotatable relative to the housing about the central axis.

14. The driving-in device as claimed in claim 5, comprising the piston guide located in front of the combustion chamber, wherein the piston guide is rotatable relative to the housing about the central axis.

15. The driving-in device as claimed in claim 3, wherein the moveable slide has a collar that encircles the central axis, which engages in an overlapping manner in a recess of a combustion chamber housing, wherein at least part of the blow-off channel is formed as an axially extending recess between the collar and the combustion chamber housing.

16. The driving-in device as claimed in claim 1, wherein the moveable slide has a collar that encircles the central axis, which engages in an overlapping manner in a recess of a combustion chamber housing, wherein at least part of the blow-off channel is formed as an axially extending recess between the collar and the combustion chamber housing.

17. The driving-in device as claimed in claim 6, wherein the moveable slide has a collar that encircles the central axis, which engages in an overlapping manner in a recess of a combustion chamber housing, wherein at least part of the blow-off channel is formed as an axially extending recess between the collar and the combustion chamber housing.

18. The driving-in device as claimed in claim 2, wherein the moveable slide has a collar that encircles the central axis, which engages in an overlapping manner in a recess of a combustion chamber housing, wherein at least part of the blow-off channel is formed as an axially extending recess between the collar and the combustion chamber housing.

19. The driving-in device as claimed in claim 6, wherein the moveable slide has a cylindrical inner wall formed as part of the combustion chamber.

20. The driving-in device as claimed in claim 14, wherein the moveable slide has a cylindrical inner wall formed as part of the combustion chamber.

21. The driving-in device as claimed in claim 16, wherein the moveable slide has a cylindrical inner wall formed as part of the combustion chamber.

* * * * *